United States Patent [19]

Meyer et al.

[11] 4,288,469

[45] Sep. 8, 1981

[54] ANODIZED ALUMINIUM ROLLERS WITH IMPROVED ELECTRICAL CONDUCTIVITY AND A PROCESS FOR THEIR MANUFACTURE

[75] Inventors: Rudolf Meyer, Leverkusen; Günther Koepke, Odenthal; Roland Hourticolon, Leichlingen, all of Fed. Rep. of Germany

[73] Assignee: Agfa-Gevaert Aktiengesellschaft, Leverkusen, Fed. Rep. of Germany

[21] Appl. No.: 95,964

[22] Filed: Nov. 20, 1979

[30] Foreign Application Priority Data

Nov. 25, 1978 [DE] Fed. Rep. of Germany ..... 2851153

[51] Int. Cl.[3] ..... C23C 9/02; B44D 1/18

[52] U.S. Cl. ..... 427/57; 427/123; 427/126.4; 427/343; 427/405; 427/419.2; 204/29; 204/38 A

[58] Field of Search ..... 204/38 A, 35 N, 25; 428/922; 29/132; 427/57, 123, 126.4, 343, 405, 419.2

[56] References Cited

U.S. PATENT DOCUMENTS

| | | | |
|---|---|---|---|
| 1,988,012 | 1/1935 | Mason | 148/6 |
| 2,151,048 | 3/1939 | Rowe | 204/25 |
| 2,151,049 | 3/1939 | Laing | 204/25 |
| 3,711,313 | 1/1973 | Nagano | 427/57 |
| 3,721,613 | 3/1973 | Wilhelm et al. | 204/38 A |
| 3,782,997 | 1/1974 | Daly et al. | 427/57 |
| 4,043,880 | 8/1977 | Yanagida et al. | 204/38 A |

FOREIGN PATENT DOCUMENTS

| | | | |
|---|---|---|---|
| 882178 | 7/1953 | Fed. Rep. of Germany | |
| 2353593 | 3/1974 | Fed. Rep. of Germany | 427/57 |

*Primary Examiner*—Ralph S. Kendall
*Attorney, Agent, or Firm*—Connolly and Hutz

[57] ABSTRACT

The electrical conductivity of the surface of eloxated aluminium rollers in the pores of the eloxation layer a metal is deposited which has little or no tendency to corrosion.

4 Claims, No Drawings

ANODIZED ALUMINIUM ROLLERS WITH IMPROVED ELECTRICAL CONDUCTIVITY AND A PROCESS FOR THEIR MANUFACTURE

This invention relates to aluminium rollers having an anodised eleoxated surface with improved electrical conductivity, and to a process for rendering anodised eloxated aluminium surfaces, in particular the surfaces of transport and guide rollers, electrically conductive.

Metal rollers are generally used for transporting webs of materials consisting of paper or plastics foils in processing machines. Steel rollers on which the surfaces are chromium plated to reduce abrasion or protect against oxidation are frequently used. The chromium plated rollers are polished to a mirror finish to protect delicate materials against scratching.

Rollers manufactured in this way have the disadvantage of being very heavy and therefore having a high moment of inertia. At the time of starting or stopping of the processing machine, these rollers lag behind and thereby scratch the surfaces of the material; moreover, chromium plating followed by mirror finishing of the surfaces is very expensive. There have therefore been many attempts to replace these heavy rollers by light metal rollers. Anodised aluminium rollers are particularly suitable. The process of anodisation, i.e. the application of the extremely hard $Al_2O_3$ layer (corundum) renders the surface of the rollers highly wear-resistant so that an ideal roller material is obtained, but the anodised oxide layer has the disadvantage of being no longer metallically conductive but on the contrary highly insulating. Due to this characteristic, the otherwise ideal roller material forfeits virtually all of its practical importance for the guiding and transport of webs of paper, film or foil. The contact of the webs of material with the surface of the rollers and as subsequent removal of the rollers, and the friction thereby produced, caused the webs to be charged up and discharged as statics. The handling of such charged plastics foils is difficult and unpleasant.

Anodised aluminium rollers are completely unsuitable for transporting or guiding lengths of photographic film or paper because the luminescence associated with charging and discharging causes pre-exposure of the photgraphic layers and renders then unusable.

It is known that when a layer of electrically oxidised aluminium is applied to an aluminium surface, usually by anodic oxidation in baths, the anodised oxide does not develop as a completely structureless layer but has channels and pores a few microns in width and diameter which are left in the developing $Al_2O_3$ layer as a result of the passage of current through it, and which vary according to the bath and the electrical conditions. These phenomena have been described in the literature, e.g. by M. Schenk in "Werkstoff Aluminium und seine anodische Oxydation (Publishers A. Franke, AG, Bern, 1948) or by A. Jenny in "Die elektrodische Oxydation des Aluminiums (publishers Th. Steinkopf, Dresden and Leipzig 1938)

It is also known to seal the channels after the anodisation process, e.g. by boiling the anodised layer in water. Another known procedure makes use of the channels or pores for colouring the layer of $Al_2O_3$. It is this procedure which provides the extraordinary range of colour shades of anodised aluminium. Processes of this type have been recorded in the literature, where the possibilities of colouring anodised aluminium with metal salts have been described.

Thus Hübner/Schiltknecht 1961 in "Praxis der anodischen Oxydation" (Aluminium-Verlag Düsseldorf) reports on inorganic colouring with metal salts and their reaction in finely divided precipitates of pure metals, e.g. methods of producing a yellow colour with copper or a brown colour with silver.

The authors also describe a process by which light-sensitive silver halide is deposited in the pores of the anodised oxide layer, thereby providing the possibility of producing photographic images which are photographically relatively insensitive but mechanically very stable after exposure and development.

No improvement in the electrical conductivity of aluminium surfaces treated in this manner was observed in any of the cases reported.

It is an object of the present invention to improve the electrical conductivity of anodised oxide layers on aluminium rollers and thereby suppress the development of electrostatic charge in the web of material carried on these rollers.

In the process according to the invention, metal salts are deposited in the previously cleaned pores of the anodies aluminium oxide surfaces, and the metal salts are reduced to metal so that an electrically conductive connection is established between the outer layer of anodised oxides and the metallic aluminium surface underneath it.

Metals which are suitable for deposition in the channels or pores of the anodised oxide layer have little or no tendency to corrosion; for example, gold, silver, copper, chromium, tungsten, molybdenum or the metals of Group VIII of the Periodic System. Metals which have a high electrical conductivity and are relatively difficult to oxidise to a less conductive compound are preferred.

A particularly suitable electrically conductive metallic connection between the outer surface and the metal surface of the body of the roller is obtained by adding wetting agents to the metal salt solutions to facilitate the penetration of the metal salt solutions.

It has also been found advantageous to treat the anodised aluminium surfaces with an aqueous cleaning solution containing surface active agent in a ultrasound bath prior to the treatment.

It was surprising to find that the surface resistance of anodised aluminium roller could be reduced from $10^{12}$ Ω to 1–10Ω by the relatively simple and inexpensive process of the invention. The conductivity of the anodised aluminium surface was thus substantially increased so that the disadvantages mentioned above, of the charging up of roller surfaces and webs of material by contact, were eliminated or reduced to a minimum. Rollers treated according to the invention could thus be used successfully for transporting photographic paper and film since spark discharges (so-called dendriform exposure) no longer occur at a surface resistance of the rollers of 1–100Ω.

The metals can no longer be removed from the pores or channels with the usual cleaning fluids or fat solvents used for treating such rollers, so that the highly conductive connection established is permanent.

One important measure for successful treatement according to the invention of an anodised aluminium roller is the thorough cleaning of the anodised surface to open up any pores or channels which may be blocked with grease. Treatment in an ultra-sound bath containing a cleaning solution at 80° C. followed by rinsing with water and thorough drying has proved to be particularly suitable for this purpose. To clean the surface in the ultra-sound bath, the aluminium roller is dipped into the cleaning liquid and the bath is exposed to the action of a source of altra-sound.

Any commercially available water-soluble cleaning agents are suitable for this purpose. These generally contain active substances such as alkyl benzene sulphonates and fatty alcohols and possibly small quantities of fatty acid ethane diamide; they also contain phosphates such as pyrophosphate or tripolyphosphate and other inorganic salts such as sodium sulphate and possibly sodium chloride and occasionally also sodium silicates, borax and soda. In addition to the aforesaid active substances they may also contain other compounds which are predominantly non-inorgenic, in particular the addition products of ethylene oxide and fatty alcohols or alkylphenols and hydrotropic clarifying additives such as urea, alcohols or other organic solvents. Th cleaning agents used according to the invention will be referred hereinafter as "cleaning liquids containing surface active agents".

As examples may be mentioned a 33% aqueous solution of the sodium salts of oxysteary sulphate and oleyl methyl taurine, an aqueous solution containing tripostassium phosphate, polyphosphate and sodium lauryl sulphate, and a 50% aqueous solution of benzyl dodecyl methyl ammonium chloride.

In order to obtain optimum conductivity, the pores and channels, which are measured in microns and very small, must be filled right down to the bottom with metal salts and the metal salts must then be reduced to metals as completely as possible. This is assisted by the addition of wetting agents to the metal salt solutions and reduction solutions.

Apart from saponin other surface active compounds may be used as wetting agents. As examples may be mentioned the wetting agents which contain ethylene oxide units in addition to carboxyl groups, such as the following compounds:

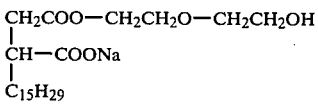

or

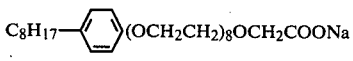

other succinic acid derivatives such as the following wetting agents:

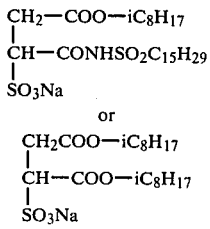

or anionic wetting agents of the perflourinated type such as, for example, the compounds of the following formulae:

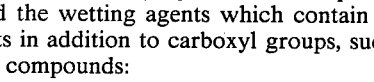

or

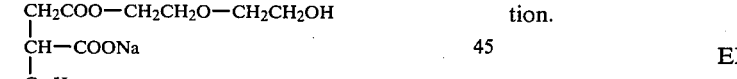

Other wetting agents containing fluorine which are suitable for the purpose of the invention have been described in Belgian Pat. No. 742,680 and in German Ofenlegungsschriften Nos. 1,942,665 and 1,950,121.

The invention will now be further described with the aid of the following Examples in which percentages refer to percentages by weight unless otherwise indicated.

EXAMPLE 1

An aluminium plate covered with a 70μ thick layer of hard anodised aluminium oxide, which has been produced in the usual manner is cleaned with a 33% aqueous solution of the sodium salts of oxystearyl sulphate and oleyl methyl tuarine at 80° C. in an ultrasound bath and then rinsed in water and dried.

A 30% aqueous solution of $H_2PtCl_6$ is applied with a brush and dried. The platinum salt is then reduced with a saturated aqueous $SnCl_2$ solution. This procedure may be repeated several times. As a result of the treatment, the surface resistance of the dry plate falls from $10_{12}$Ω to 95Ω.

EXAMPLE 2

The cleaning of the anodised aluminium plate and application of the metal salt are carried out as described in Example 1. The reduction is carried out using a 2% phenidone solution in acetone. 3 cc of a 4% aqueous solution of the compound of the formula $C_8F_{17}SO_3N(C_2H_5)_4$ per liter of phenidone solution are added as wetting agent.

EXAMPLE 3

As a modification of example 1, the metal salt solution used is an aqueous normal solution $HAuCl_4$ containing 5 cc per liter of a 10% aqueous saponin solution. Reduction is carried out using a 4% aqueous hydrazine solution.

EXAMPLE 4

As a modification of example 1, the metal salt solution used is a 15% aqueous solution of $Na_2PdCl_4$ containing 3 cc per liter of a 4% aqueous solution of the wetting agent of the formula $C_8F_{17}SO_3N(C_2H_5)_4$.

Reduction is carried out using a 2% phenidone solution in acetone.

EXAMPLE 5

A saturated aqueous $AgNo_3$ solution containing 3 cc per liter of a 4% aqueous solution of the wetting agent corresponding to the formula, $C_8F_{17}SO_3N(C_2H_5)_4$ is applied several times to the anodised aluminium oxide layer produced according to Example 1. Reduction is carried out using a 1:1 mixture of a 2% solution of phenidone in acetone and a 4% aqueous hydrazine solution. The reduction solution contains 3 cc per liter of the 4% aqueous solution of the wetting agent corresponding to the formula, $C_8F_{17}SO_3N(C_2H_5)_4$.

EXAMPLE 6

A saturated aqueous $AgNo_3$ solution containing 3% by weight per liter of a 10% aqueous solution of saponin as wetting agent is applied to the anodised aluminium oxide layer of Example 1. This is then bathed in a aqueous 2 N NaCl solution. This procedure is repeated several times. The following reduction solution is then used:

| | | |
|---|---|---|
| Solution 1 | $K_2Cn_2O_4$ | 100 g |
| | Water | 400 cc |
| Solution 2 | $FeSO_4$ | 100 g |
| | Citric acid | 1 g |
| | Water | 300 cc |

4 parts by volume of solution 1 are mixed with 1 part by volume of solution 2 and to this mixture are added 5 parts by volume of water. The resulting mixture is left to act on the anodised aluminium oxide layer for 5 minutes 20° C.

EXAMPLE 7

The anodised oxide layer treated as in Example 1 is bathed several times in a saturated aqueous solution of chrome alum. Reduction is subsequently carried out using a 2% aqueous hydrazine solution.

EXAMPLE 8

A saturated aqueous $CuCl_2$ solution is applied to the eloxal layer of Example 1 and then reduced with a 2% aqueous hydrazine solution.

Both solutions contain 5 cc per liter of a 10% aqueous saponin solution as wetting agent in order to ensure that the solution of the metal salts and the reducing agents will penetrate right down to the bottom of the pores and channels of the anodised oxide layer to reach the metallic aluminium.

The conductive layers produced according to the examples on the external surfaces of the anodised oxide layers have surface resistances ranging from 1Ω to 100Ω according to the treatment time, number of repetitions of the treatment and quantity of wetting agent used.

Measurement of the surface resistances was carried out according to DIN 53 482, Method A at 20° C. and 60% relative humidity.

We claim:

1. A process for producing a transporting roller comprised of aluminum with a surface adapted for transporting photographic materials and having a highly insulating porous anodic oxide formed on the member surface, with conductive surfaces on the anodized oxide layer including the steps of immersing the member in an aqueous cleaning liquid subjecting the anodic oxide layer of the immersed member to ultrasonic treatment impregnating the pores of the treated oxide layer with an aqueous solution of a wetting agent and the salt of a conductive and corrosion-resistant metal, treating the impregnated metal salt with a solution of a reducing agent to reduce the metal salt in the oxide, and forming a conductive layer on the outer surface of the oxide layer and conductive surfaces in the pores so that the surface layer is in conductive connection with the aluminum roller.

2. Process according to claim 1, characterised in that aqueous solutions of metal salts taken from the group comprising copper, silver, gold, chromium, tungsten, molybdenum and Group VIII of the Periodic System are used.

3. A process as claimed in claim 1 in which the wetting agent is saponin, a wetting agent which contans ethylene oxide units and carboxyl groups, a succinic acid derivative or an anionic wetting agent of the perfluorinated type.

4. A process for producing electrical conductivity between a transporting roller comprised of aluminum with a surface adapted for transporting photographic materials and having a highly insulating porous anodic oxide formed on the member surface, and conductive surfaces on the anodized oxide layer said process including the steps of immersing the member in an aqueous cleaning liquid subjecting the anodic oxide layer of the immersed member to altrasonic treatment impregnating the pores of the treated oxide layer with an aqueous solution of a wetting agent and the salt of a conductive and corrosion-resistant metal, treating the impregnated metal salt with a solution of a reducing agent to reduce the metal salt in the oxide, and forming a conductive layer on the outer surface of the oxide layer and conductive surfaces in the pores so that the surface layer is in conductive connection with the aluminum roller with a conductivity in the range of from 1–100 ohms.

* * * * *